US006460553B1

(12) United States Patent
Owens et al.

(10) Patent No.: US 6,460,553 B1
(45) Date of Patent: Oct. 8, 2002

(54) TANK-CLEANING DEVICE

(75) Inventors: Robert A. Owens, Eastleigh (GB); Poul Anton Daugaard, Jordrup (DK)

(73) Assignee: Alfa Laval LKM A/S, Kolding (DK)

( * ) Notice: Subject to any disclaimer, the term of this patent is extended or adjusted under 35 U.S.C. 154(b) by 0 days.

(21) Appl. No.: 09/646,494

(22) PCT Filed: Feb. 18, 1999

(86) PCT No.: PCT/EP99/01063

§ 371 (c)(1),
(2), (4) Date: Sep. 18, 2000

(87) PCT Pub. No.: WO99/47271

PCT Pub. Date: Sep. 23, 1999

(30) Foreign Application Priority Data

Mar. 17, 1998 (DE) ..... 198 11 421

(51) Int. Cl.[7] ..... B08B 9/093
(52) U.S. Cl. ..... 134/167 R; 239/227
(58) Field of Search ..... 134/167 R, 168 R, 134/176, 179; 239/227, 240

(56) References Cited

U.S. PATENT DOCUMENTS 3,052,574 A * 9/1962 Kennedy ..... 134/179 X

FOREIGN PATENT DOCUMENTS

| | | |
|---|---|---|
| DE | 1 079 667 | 4/1960 |
| DE | 37 17 716 A | 10/1987 |
| DE | 40 24 325 A | 3/1991 |
| DE | 40 28 242 A | 3/1992 |
| DE | 195 30 721 A | 2/1997 |
| DE | 196 25 104 A | 1/1998 |
| EP | 0 430 659 A2 | 6/1991 |
| EP | 0 519 179 A | 12/1992 |

* cited by examiner

*Primary Examiner*—Philip R. Coe
(74) *Attorney, Agent, or Firm*—Michael J. Striker

(57) ABSTRACT

A tank-cleaning device, having a housing (1) insertable into an opening of a tank, which housing has a rotationally fixed housing part (2) communicating with an ink for the cleaning fluid and a nozzle holder (4) rotatable relative to the rotationally fixed housing part (2) about a first pivot axis (5), and having at least one nozzle assembly with four nozzles (8, 9, 10, 11) that is disposed on the nozzle holder (4) rotatably about a second pivot axis (7), while having a simple structure, enables thorough cleaning of tanks with narrow tank openings, if two nozzles at a time (8, 9; 10, 11) of the nozzle assembly (6) are disposed at an acute angle (12) to one another in the form of respective V-formations (13, 14), and the two V-formations (13, 14) have essentially opposed directions (15).

9 Claims, 4 Drawing Sheets

3
24
40
22
23
21
2
1
27
25
26
31
28
29
9
30
32
35
33
6
34
7
36
37
4
5
10

TANK-CLEANING DEVICE

BACKGROUND OF THE INVENTION

The invention relates to a tank-cleaning device, having a housing insertable into an opening of a tank, which housing has a rotationally fixed housing part communicating with an ink for the cleaning fluid and a nozzle holder rotatable relative to the rotationally fixed housing part about a first pivot axis, and having at least one nozzle assembly with four nozzles that is disposed on the nozzle holder rotatably about a second pivot axis.

A similar tank-cleaning device is known from European Patent Disclosure EP 0 430 659 A2. This known tank-cleaning device has a slender housing, which can be introduced even into a narrow tank opening. The nozzle assembly has only two nozzles, which are disposed at an angle of 180° to one another. When the housing is introduced into a narrow tank opening, the nozzle assembly is rotated in such a way that the common axis of the two nozzles is parallel to the longitudinal axis of the housing. The tank opening therefore has to have an only slightly greater diameter than the slender housing of the tank-cleaning device. A small tank opening can advantageously be manufactured much more economically than a large one.

On the inside surface of the tank, during the cleaning operation, the two nozzles create a certain netlike spray pattern, which at a fixed, predetermined ratio of the two rotary motions about the two aforementioned pivot axes is always repeated after a certain number of rotations and has a fixed "mesh width". The paths traced on the inside surface of the tank by the fluid streams come to have a fixed density, which cannot be increased even by providing a long cleaning period, since the fluid streams always travel along the same paths.

In other known devices, the cleaning density has therefore been reduced by the disposition of four nozzles instead of two nozzles. The four nozzles in the known nozzle assemblies are always disposed at uniform angular intervals of 90° each from one another. The reason for this is that in the known tank-cleaning devices, the nozzles rotate uniformly about a typically horizontally disposed pivot axis, while the entire nozzle assembly rotates uniformly about a typically vertical pivot axis. Given the equal 90° angular spacings of the nozzles, the result is accordingly a uniform spray pattern without major gaps on the inside surface of the tank.

The known nozzle assemblies with four nozzles have the disadvantage, however, that when they are introduced into a narrow tank opening, not all the nozzle axes can be adjusted parallel to the longitudinal axis of the housing anymore, or at least not unless further complicated engineering provisions are made. With very narrow tank openings, one is therefore forced to shorten the nozzle length, but this leads to a poorer quality of the fluid stream and less-effective cleaning, with poorer outcomes of cleaning. This means in turn, however, that so far, there has been no tank-cleaning device with four nozzles that fits through a narrow tank opening and nevertheless furnishes a fluid stream that attains effective cleaning.

SUMMARY OF THE INVENTION

The object of the present invention is therefore to disclose a tank-cleaning device which with a simple structure permits thorough cleaning of tanks with narrow tank openings.

This object is attained according to the invention in that two nozzles at a time of the nozzle assembly are disposed at an acute angle to one another in the form of respective V-formations, and the two V-formations have essentially opposed directions.

Surprisingly, it has been found that with the arrangement of nozzles in V-formations that form an acute angle, in accordance with the invention, a uniform spray pattern without major gaps can be created. If this nozzle assembly is rotated such that one V-formation points upward and the other points downward, then the longer dimension of the nozzle assembly is oriented in the direction of the longitudinal axis of the housing. The minimum required diameter of the tank opening is then determined only by the housing width and by the slenderer dimension of the nozzle assembly.

In a preferred embodiment, it is provided that the rotation of the nozzle holder about the first pivot axis and the rotation of the nozzle assembly about the second pivot axis are mechanically coupled to one another and have a fixed ratio to one another, so that the spray pattern repeats after a certain number of revolutions, and that the acute angles of the V-formations are adapted to the ratio of the two rotations with a view to a uniform spray pattern. If the ratio of the rotations is fixed, then by a skilled selection of the acute angle a uniform spray pattern without major gaps can be created that does not substantially differ from the spray pattern of known tank-cleaning devices that have four nozzles each disposed at right angles.

If the first pivot axis coincides with the longitudinal axis of the housing and is disposed perpendicular to the second pivot axis, and if the ratio of the two rotations is 45:43, then with a view to a uniform spray pattern it is optimal that the acute angles of the V-formations amount to approximately 40°. With this arrangement of the pivot axes, uniform rotary motions can be generated by simple means. It can be calculated that at the aforementioned ratio of the two rotations, the following angles between the nozzles can be considered for attaining a uniform spray pattern: 90.00°; 81.63°; 73.26°; 64.88°; 56.51°; 48.14°; 39.77°; 31.40°; 23.02°; 14.65°; and 6.28°. The angle of 39.77° chosen here, or in round numbers 40°, represents an advantageous compromise with a view to a uniformly dense spray pattern with the smallest possible tank opening.

The provision that the two V-formations are disposed symmetrically to one another, so that two nozzles at a time point in opposite directions also contributes to the uniformity of the spray pattern.

If the two V-formations are disposed offset from one another, so that their pointed tips are each radially spaced apart from the second pivot axis, and the connecting line between the two pointed tips is substantially perpendicular to the angle bisector of the two acute angles, then the nozzles can be embodied advantageously long while optimally utilizing the little installation space available, so as to improve the quality of the fluid stream and the effectiveness of the cleaning.

If a turbine and a gear for driving the rotatable nozzle assembly are disposed in the elongated and slender rotationally fixed housing part in such a way that the cleaning fluid flowing in under pressure from the ink flows through the housing and drives the turbine before it emerges from the nozzles, then a slender device is obtained which is suitable for introduction into narrow tank openings and includes a simple drive mechanism for the two rotary motions, so as to assure thorough, uniform cleaning of the inside surfaces of the tank.

The invention can be improved still further in that an angular play of approximately 180° is provided between an element that drives the rotary motion of the nozzle assembly about the second pivot axis and the drive shaft of the nozzle assembly. As a result, in the range of the angular play, an alignment of the nozzle assembly longitudinally of the housing is made possible from any arbitrary rotary position, without having to activate the rotational drive mechanism. It is therefore possible for a nozzle assembly that may not be positioned correctly to be aligned by hand for insertion into a narrow tank opening, without having to rotate the drive elements as well, and without unnecessarily using up the cleaning fluid otherwise required for drive purposes.

In an advantageous feature of the aforementioned angular play, the drive shaft is provided with a pin, which protrudes radially past its outside diameter and engages a recess, extending in the direction of rotation over an angular range of 180°, in the hub region of a cone wheel supported rotatably on the drive shaft.

Another advantageous feature provides that a platelike baffle connected to the drive shaft in a manner fixed against relative rotation, in the hub region, has a first protrusion protruding axially inward and extending in the direction of rotation over an angular range of 90°; that a cone wheel rotatably supported on the drive shaft, in the hub region, has a second protrusion protruding axially outward, counter to the first protrusion, projecting in the same axial region as the first protrusion and extending in the direction of rotation over an angular range of 90°, so that the relative rotation between the platelike baffle and the cone wheel is limited to an angular range of 180° by the protrusions stopping against one another in the direction of rotation. The protrusions can be integrally molded in a simple way during production, in particular simultaneously with the casting of the cone wheel and baffle, with requiring further work steps such as inserting a pin into the drive shaft.

BRIEF DESCRIPTION OF THE DRAWINGS

Further advantages and details of the invention will become apparent from ensuing description of an exemplary embodiment in conjunction with the drawings.

Individually, the drawings show the following.

DESCRIPTION OF THE PREFERRED EMBODIMENTS

Figure 1:
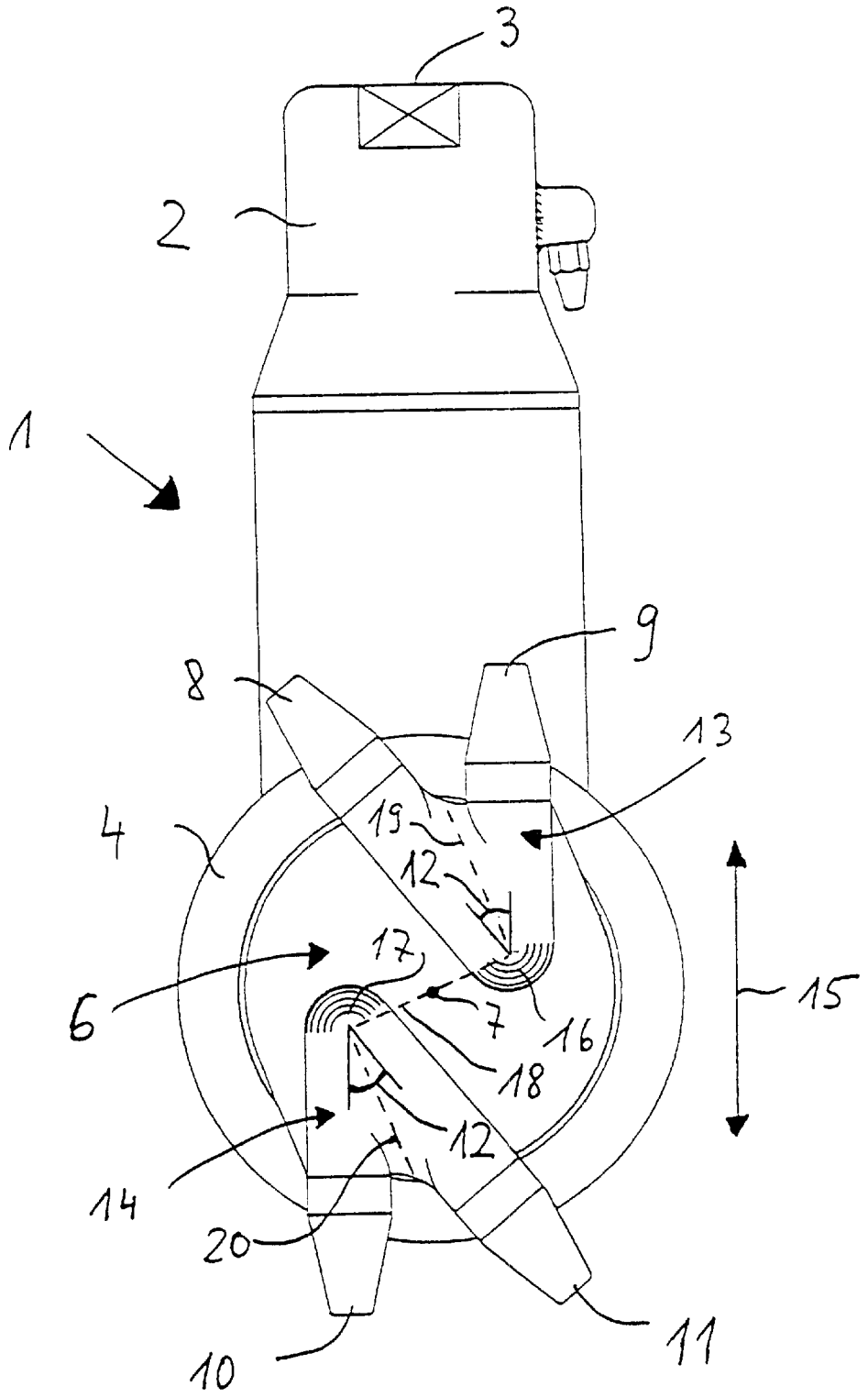
FIG. 1, a tank-cleaning device according to the invention in a plan view.
Figure 2:
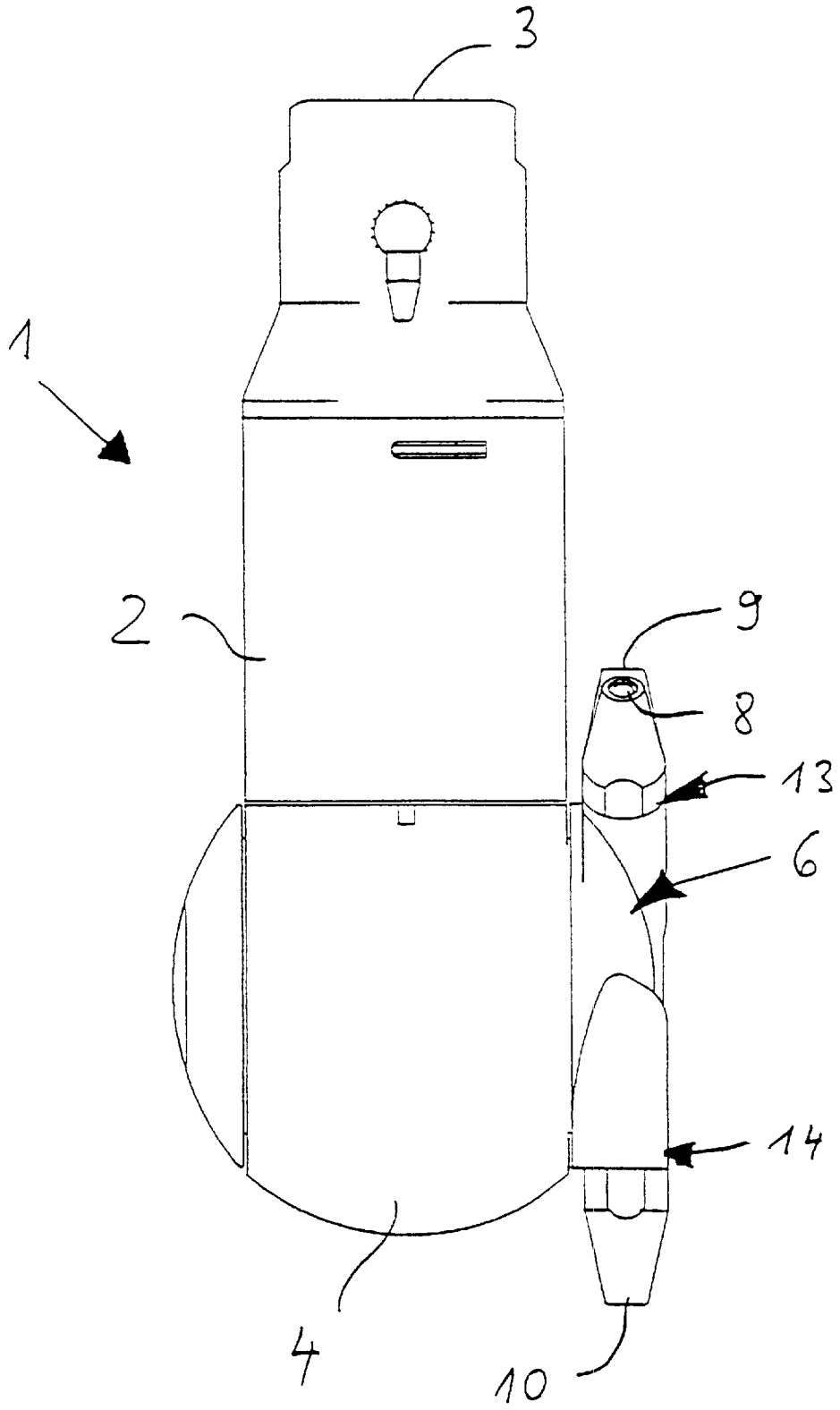
FIG. 2, a side view of the same tank-cleaning device.

The tank-cleaning device shown in the drawings comprises a housing 1, which can be introduced into a narrow tank opening, not shown, and therefore has a slender shape. The housing a rotationally fixed housing part 2, which on its top has an infeed opening 3 for connection of a source, not shown, for the cleaning fluid. The housing 1 also has a nozzle holder 4, which is rotatable about a first pivot axis 5 relative to the rotationally fixed housing part 2. A nozzle assembly 6 is supported on the nozzle holder 4 in a manner rotatable about a second pivot axis 7.

The nozzle assembly 6 has four nozzles 8, 9, 10, 11, of which two at a time, that is, 8, 9 on the one hand and 10, 11 on the other, are disposed at an acute angle 12 of approximately 40° from one another to form V-formations 13 and 14, respectively. The two V-formations 13, 14 are disposed relative to one another such that they point in opposite directions 15. This creates a nozzle assembly 4 that has a greater length in the directions 15 than transversely to these directions 15.

If the nozzle assembly 4 is now aligned as shown in the drawings, that is, with the directions 15 parallel to the longitudinal direction of the housing 1, then the tank-cleaning device can be introduced into even very narrow tank openings.

The two V-formations 13, 14 are disposed symmetrically to one another; the nozzles 9 and 10 point in opposite directions 15, on the one hand, while the nozzles 8 and 11 also point in corresponding opposed directions. As best seen from FIG. 1, the V-formations 13, 14 are also offset from one another, so that their pointed tips 16, 17 are spaced apart from the second pivot axis 7. The connecting line 18 between the two pointed tips 16, 17 is approximately perpendicular to the respective angle bisector 19, 20 of the two acute angles 12. It is understood that to improve the compactness of the nozzle assembly 4, the V-formations 13, 14 can also be offset in some other way than in the exemplary embodiment shown, and in particular can be displaced along the angle bisector 19, 20.

Figure 3:
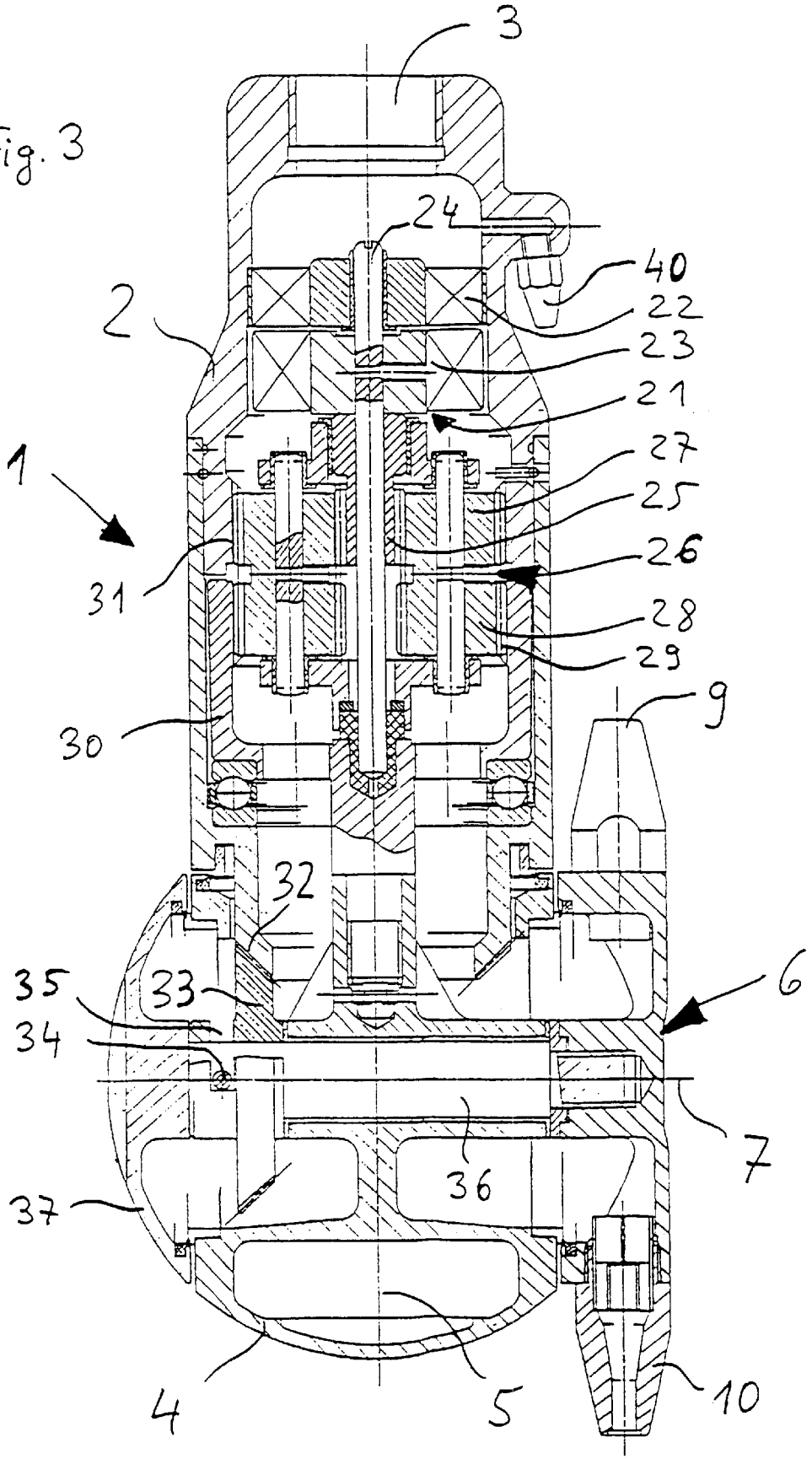
FIG. 3, a sectional view of the same tank-cleaning device.

As seen best from FIG. 3, the first pivot axis 5 is disposed perpendicular to the second pivot axis 7 and coincides with the longitudinal axis of the housing 1. The rotationally fixed housing part 2 is embodied as elongated and slender, so that it fits through narrow tank openings. Through the infeed opening 3, cleaning fluid flows under pressure into the interior of the housing 1. A turbine 21 with a stator 22 and a rotor 23 is disposed in the housing part 2. The rotor 23 is seated on a rotor shaft 24, with which a sun wheel 25 of a planetary gear 26 is also connected in a manner fixed against relative rotation.

The cleaning fluid flows through blades of the stator 22 and the rotor 23 and drives the rotor. The rotor 23 thus turns the sun wheel 25, which drives first encompassing gear wheels 27, which in turn are connected to second encompassing gear wheels 28 in a manner fixed against relative rotation. The second gear wheels 28 revolve on a set of internal teeth 31 of the rotationally fixed housing part 2. The two gear wheels 27, 28 have the same number of teeth. One set of internal teeth 29 has a number of teeth that differs by one from the other set of internal teeth 31, so that after one revolution of the two gear wheels 27, 28, the rotary part 30 and the nozzle holder 4 have rotated by a small angle relative to the rotationally fixed housing part 2, the angle corresponding to the difference in the numbers of teeth.

The rotationally fixed housing part 2, in its lower region, has a conical set of teeth 32, which meshes with a cone wheel 33 disposed on the second pivot axis 7. The cone wheel 33 is connected in a manner fixed against relative rotation to the nozzle assembly 6 that is supported rotatably about the second pivot axis 7. When the turbine drive now necessarily rotates the nozzle holder 4 about the first pivot axis 5, the second pivot axis 7 is pivoted, and the cone wheel 3 rolls along the conical teeth 32 of the rotationally fixed housing part 2. In the process, the cone wheel 33 rotates the nozzle assembly 6 about the second pivot axis 7. Both rotary motions take place uniformly.

The conical set of teeth 32 forty-five teeth, while the cone wheel 33 has only forty-three teeth. This means that the spray pattern created by the nozzles 8, 9, 10, 11 does not repeat until after forty-five revolutions of the nozzle assembly 6 and after forty-three revolutions of the nozzle holder 4. The mechanical coupling with the fixedly specified ratio of 45:43 between the two rotary motions, together with the acute angle 12 of 40°, produces an optimal adaptation.

Downstream of the turbine 21, the cleaning fluid also flows through the planetary gear 26 and then reaches the inside of the nozzle holder, and from there it is pressed into the nozzle assembly 6 and finally emerges from the nozzles 8, 9, 10, 11 and is sprayed at the inside surface of the tank. Because of the uniform double rotary motion about the two pivot axes 5, 7, a spray pattern is created that uniformly covers the inside surface of the tank.

Figure 6:
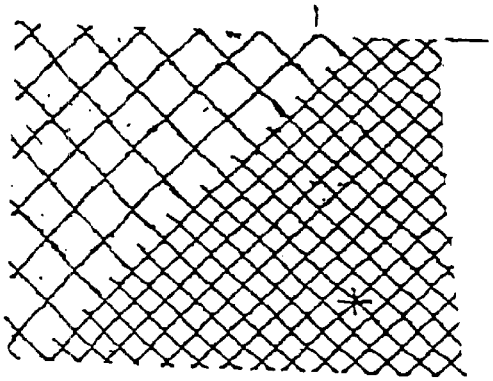
FIG. 6, a detail showing the spray patterns of tank-cleaning devices having four nozzles and two nozzles, compared directly with one another.
Figure 5:
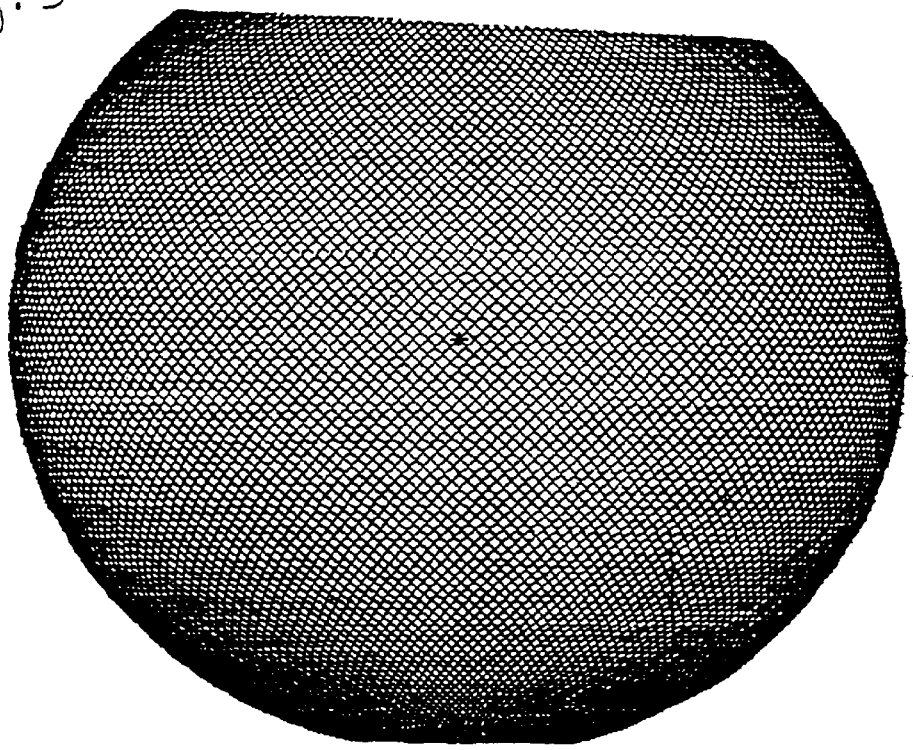
FIG. 5, a spray pattern produced with the tank cleaning device according to the invention.

One such spray pattern is shown in FIG. 5. The paths taken by the fluid stream are distributed substantially uniformly over the inside surface of the tank. A direct comparison between the spray patterns of a four-nozzle machine and a two-nozzle machine is shown in FIG. 6. As can easily be seen, the spacing between adjacent paths and the mesh width in a two-nozzle machine are twice as large as in a four-nozzle machine.

As can be seen from FIG. 3, the drive shaft 36 of the nozzle assembly 6 is provided with a pin 34 protruding radially past the outside diameter of the nozzle assembly; the pin is pressed into a bore intended for it in the drive shaft 36. The pin 34 projects radially outward and engages a recess 35 in the hub region of the cone wheel 33 that is rotatably supported on the drive shaft 36. The recess 36 extends in the direction of rotation over an angular range of 180°, so that the cone wheel 33 can be rotated relative to the drive shaft 36 by up to 180° within the angular play, before the pin 34 strikes one of the boundaries of the recess 35 in the direction of rotation and the drive shaft 36 is driven by the cone wheel 33.

This provision assures free rotatability of the nozzle assembly 6, connected to the drive shaft 36 in a manner fixed against relative rotation, within the angular play while the cone wheel 33 is stationary, so that an alignment of the two V-formations 13, 14 longitudinally of the housing is possible even when the drive mechanism is at a standstill.

Figure 4:
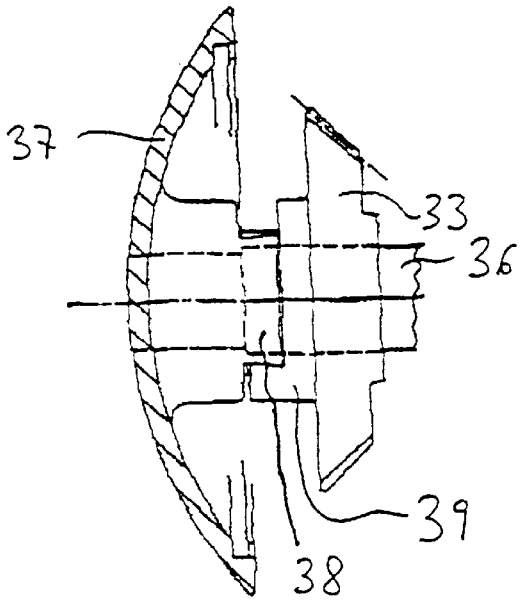
FIG. 4, a detail of a tank-cleaning device of the invention in a further version.

In the modified embodiment of the angular play shown in FIG. 4, a platelike baffle 37 that covers the backside of the nozzle holder 4, is connected to the drive shaft 36 in a manner fixed against relative rotation, and rotates together with this drive shaft, is equipped in its hub region with an axially inward-projection protrusion 38, which extends over an angular range of 90° in the direction of rotation. The cone wheel 33 rotatably supported on the drive shaft 36 is likewise equipped in its help region with an axial protrusion 39, which projects in the axial direction outward, counter to the first protrusion 38, in the same axial region as the first protrusion and which likewise extends in the direction of rotation over an angular range of 90°.

Together, the two protrusions 38, 39 cover an angular range of 180°, so that the relative rotation between the platelike baffle 37 and the cone wheel 33 is limited by the protrusions 38, 39, striking one another in the direction of rotation, to the remaining angular range, which again is 180°. In this arrangement, the cone wheel 33 can accordingly be rotated relative to the baffle 37 by up to 180° within the angular play, before the protrusion 39 of the cone wheel 33 strikes the protrusion 38 of the baffle 37 in the direction of rotation, and thus before the drive shaft 36 is driven by the cone wheel 33 via the baffle 37.

For self-cleaning of the tank-cleaning device, a special spray nozzle 40 is provided, which is disposed in the upper region of the rotationally fixed housing part 2 and whose spray direction is oriented downward in the direction of the nozzle assembly 6. Still further spray nozzles can also be provided for the self-cleaning.

What is claimed is:

1. A tank-cleaning device, having a housing (1) insertable into an opening of a tank, which housing has a rotationally fixed housing part (2) communicating with a source of a cleaning fluid and a nozzle holder (4) rotatable relative to the rotationally fixed housing part (2) about a first pivot axis (5), and having at least one nozzle assembly with four nozzles (8, 9, 10, 11) that is disposed on the nozzle holder (4) rotatably about a second pivot axis (7), wherein two nozzles at a time (8, 9; 10, 11) of the nozzle assembly (6) are disposed at an acute angle (12) to one another in the form of respective V-formations (13, 14), and the two V-formations (13, 14) have essentially opposed directions (15).

2. The tank-leaning device of claim 1, wherein the rotation of the nozzle holder (4) about the first pivot axis (5) and the rotation of the nozzle assembly (9) about the second pivot axis (7) are mechanically coupled to one another and have a fixed ratio to one another, so that a spray pattern repeats after a certain number of revolutions, and that the acute angles (12) of the V-formations (13, 14) are adapted to the ratio of the two rotations to provide a uniform spray pattern.

3. The tank-cleaning device of claim 2, wherein the first pivot axis (5) coincides with a longitudinal axis of the housing (1) and is disposed perpendicular to the second pivot axis (7); that the ratio of the two rotations is 45:43; and that the acute angles (12) of the V-formations (13, 14) amount to approximately 40°.

4. The tank-cleaning device of claim 1, wherein the two V-formations (13, 14) are disposed symmetrically to one another, so that two nozzles at a time (8, 11; 9, 10) point in opposite directions.

5. The tank-cleaning device of claim 1, the two V-formations (13, 14) are disposed offset from one another and have pointed tips (16, 17) are each radially spaced apart from the second pivot axis (7), and a connecting line (18) between the two pointed tips (16, 17) is substantially perpendicular to a angle bisector (19, 20) of the two acute angles (12).

6. The tank-cleaning device of claim 1, wherein a turbine (21) and a gear (26) for driving the rotatable nozzle assembly (6) are disposed in an elongated and slender rotationally fixed housing part (2) in such a way that the cleaning fluid under pressure flows through the housing (1) and drives the turbine (21) before it emerges from the nozzles (8, 9, 10, 11).

7. The tank-cleaning device of claim 6, wherein an angular play of approximately 180° is provided between an element (4, 32, 33) that drives the rotary motion of the nozzle assembly (6) about the second pivot axis (7) and a drive shaft (36) of the nozzle assembly (6).

8. The tank-cleaning device of claim 7, wherein the drive shaft (36) is provided with a pin (34), which protrudes radially past an outside diameter of the drive shaft and engages a recess (35), extending in the direction of rotation over an angular range of 180°, in a hub region of a cone wheel (33) supported rotatably on the drive shaft (36).

9. The tank-cleaning device of claim 7, a platelike baffle (37) connected to a drive shaft (39) in a manner fixed against relative rotation has a first protrusion (38) in region, protruding axially inward and extending in the direction of rotation over an angular range of 90°; that a cone wheel (33) rotatably supported on the drive shaft (36), a second protrusion (39) in the hub region, protruding axially outward, counter to the first protrusion (38), projecting in a same axial region as the first protrusion (38) and extending in a direction of rotation over an angular range of 90°, so that the relative rotation between the platelike baffle (37) and the cone wheel (33) is limited to an angular range of 180° by the protrusions (38, 39) stopping against one another in the direction of rotation.

* * * * *